US006863502B2

(12) United States Patent
Bishop et al.

(10) Patent No.: US 6,863,502 B2
(45) Date of Patent: Mar. 8, 2005

(54) VARIABLE SPEED HYDRAULIC PUMP

(75) Inventors: Michael B. Bishop, Madison, WI (US); Roger R. Pili, Madison, WI (US); Bruce E. Knuth, Marshall, WI (US); Moe K. Barani, Radford, VA (US); Ron Flanary, Blacksburg, VA (US); Laurentius A. G. Mentink, Haaksbergen (NL); George R. Steber, Mequon, WI (US); Martin Piedl, Blacksburg, VA (US)

(73) Assignee: Actuant Corporation, Milwaukee, WI (US)

( * ) Notice: Subject to any disclaimer, the term of this patent is extended or adjusted under 35 U.S.C. 154(b) by 0 days.

(21) Appl. No.: 10/257,302

(22) PCT Filed: Apr. 13, 2001

(86) PCT No.: PCT/US01/12221

§ 371 (c)(1),
(2), (4) Date: Mar. 12, 2003

(87) PCT Pub. No.: WO01/79697

PCT Pub. Date: Oct. 25, 2001

(65) Prior Publication Data

US 2003/0206805 A1 Nov. 6, 2003

Related U.S. Application Data

(63) Continuation-in-part of application No. 09/568,763, filed on May 11, 2000, now Pat. No. 6,299,233.
(60) Provisional application No. 60/197,789, filed on Apr. 14, 2000.

(51) Int. Cl.[7] ..... F04B 49/06
(52) U.S. Cl. ..... 417/44.2; 417/44.1; 417/42; 417/280; 417/476; 92/72
(58) Field of Search ..... 417/44.2, 44.1, 417/42, 18, 22, 250, 280, 476; 92/72

(56) References Cited

U.S. PATENT DOCUMENTS

| | | | | |
|---|---|---|---|---|
| 2,130,299 A | | 9/1938 | Ernst | |
| 4,313,714 A | * | 2/1982 | Kubeczka | 417/273 |
| 4,511,312 A | | 4/1985 | Hartwig | |

(List continued on next page.)

FOREIGN PATENT DOCUMENTS

| | | |
|---|---|---|
| DE | 27 18 868 A1 | 9/1978 |
| EP | 0 718 496 A2 | 6/1996 |
| EP | 0 750 116 A1 | 12/1996 |
| GB | 953927 A | 4/1964 |

OTHER PUBLICATIONS

International Search Report issued in connection with International Patent Application PCT/US01/12221, under date of mailing of Nov. 26, 2001.

*Primary Examiner*—Charles G. Freay
(74) *Attorney, Agent, or Firm*—Quarles & Brady LLP

(57) ABSTRACT

The invention provides a variable speed hydraulic pump designed to operate at a maximum horsepower throughout its pressure range by adjusting motor speed according to motor load parameters. In particular, the variable speed hydraulic pump includes a hydraulic pump unit coupled to a variable speed electric motor by a drive unit and to a hydraulic fluid tank for pressurizing and pumping hydraulic fluid when operated by the motor. A motor controller is electrically connected to the motor to supply drive signals to the motor based on electrical characteristics of the drive signals which are dependent on the load exerted on the motor. Suction from the load is provided by both the main pump and a bidirectional supercharging pump by reversing the direction of the motor and shifting a 4/3 valve to connect the main pump inlet to the load and its outlet to tank. In addition, the controller reduces the motor speed at the maximum rated pressure to just maintain the pressure, to reduce the amount of fluid pumped through the maximum pressure relief valve.

19 Claims, 5 Drawing Sheets

U.S. PATENT DOCUMENTS 5,181,837 A * 1/1993 Niemiec ..... 417/350
5,651,667 A * 7/1997 Sand et al. ..... 417/572
5,738,500 A * 4/1998 Sundberg et al. ..... 417/204
5,813,315 A * 9/1998 Kristensen et al. ..... 92/71
5,865,602 A * 2/1999 Nozari ..... 417/44.1
5,927,073 A * 7/1999 Ishizaki et al. ..... 60/487
5,937,646 A * 8/1999 Zakula ..... 60/430
6,209,825 B1 * 4/2001 Scott ..... 244/226

* cited by examiner

FIG. 6
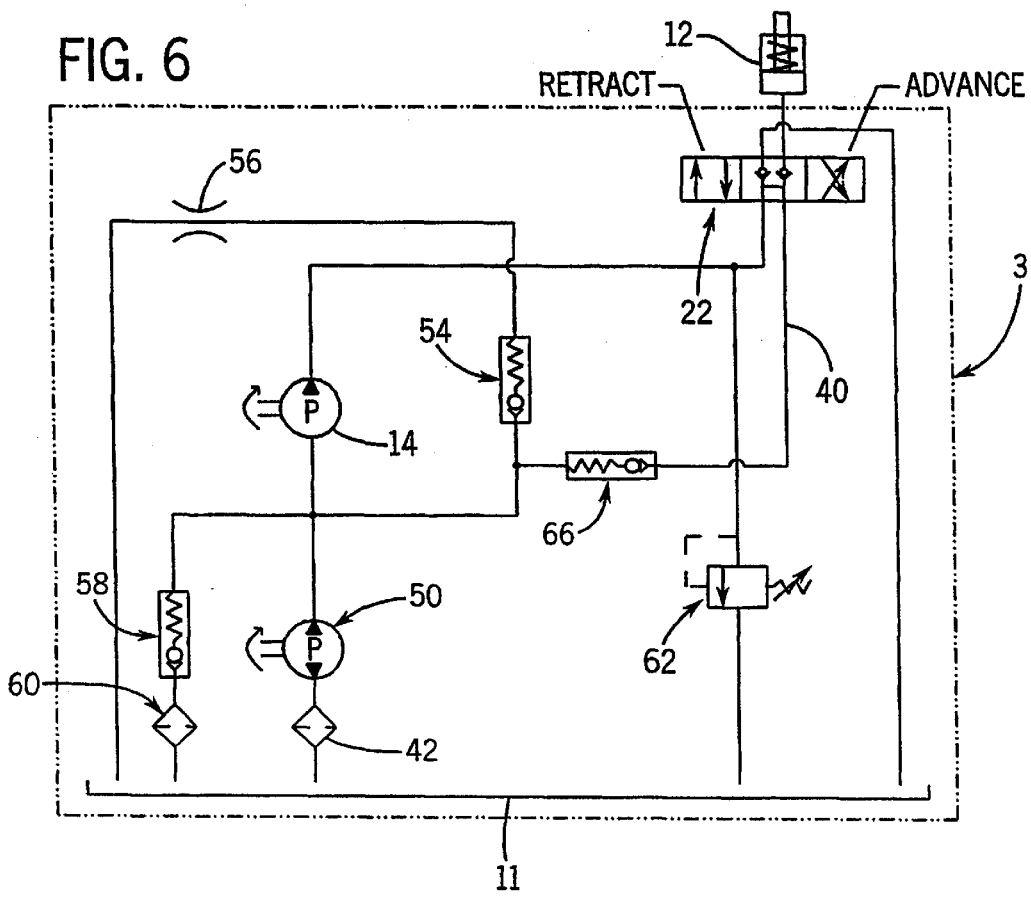
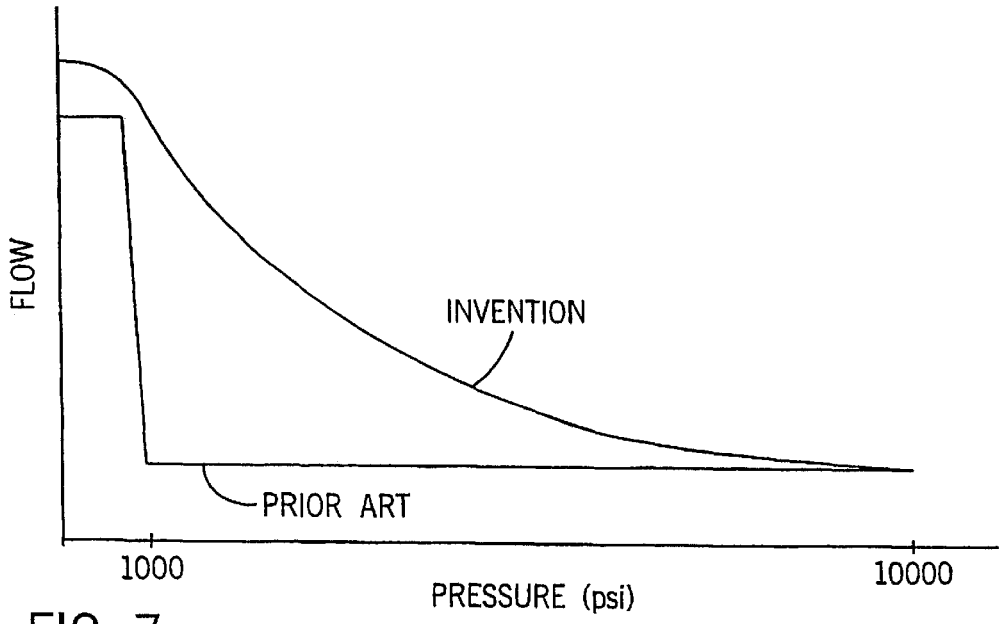
FIG. 7

VARIABLE SPEED HYDRAULIC PUMP

CROSS REFERENCE TO RELATED APPLICATIONS

This application claims the benefit of U.S. Provisional Patent Application Ser. No. 60/197,789 filed Apr. 14, 2000, and is a CIP of U.S. patent application Ser. No. 09/568,763 filed May 11, 2000 now U.S. Pat. No. 6,299,233.

STATEMENT OF GOVERNMENT SPONSORED RESEARCH/DEVELOPMENT

Not applicable.

BACKGROUND OF THE INVENTION

1. Field of the Invention

This invention relates to hydraulic pumps, and in particular to a variable speed hydraulic pump.

2. Discussion of the Prior Art

Hydraulic pumps are useful for providing power to a work producing device by means of hydraulic fluid under pressure. Hydraulic pumps are used to supply hydraulic fluid pressure for lifting, pressing, punching, and other mechanical operations when used with suitable hydraulic presses, punches, cylinders, and other devices.

Pumps which provide the fluid for these applications typically have a nonlinear flow versus pressure characteristic curve. At low pressures, the flow is high and as the pressure increases, at a certain pressure the flow is drastically reduced. Having a high flow at low pressures greatly reduces cycle times for improved productivity and produces high performance for industrial applications, and the ability to produce high pressures, albeit at lower flows, makes the pump suitable for high force applications.

Pumps of this type are typically a two stage design, utilizing a first stage gear pump and a second stage piston pump. The low pressure pump is either a gear pump, gerotor pump, or a large piston pump. The second stage pump is usually a relatively small diameter piston pump capable of producing high pressures. Below 1000 psi, the first stage pump supplies the oil at a high flow rate. When the pressure reaches about 1000 psi and above, the first stage bypass valve opens to relieve pressure from the first stage pump to the tank pressure, and the second stage pump will supply the fluid at these higher pressures.

The flow of the first stage excess output (the flow not delivered to the load) over the bypass valve creates heat and, in excess, breaks down the oil. Heat exchangers were often required on such pumps to preserve the hydraulic fluid quality. When the second stage pump reaches the maximum pressure, typically around 10,000 psi, the flow from the second stage pump is dumped over a relief valve to limit the pressure. This dumping also creates a large amount of heat because the heat generated is a function of the flow and pressure. These flow characteristics are illustrated in FIG. 7 as the current (prior art) pump. In one aspect, the present invention addresses the problem of excess heat developed in the fluid by dumping fluid over the pressure relief valve at the pressure limit of the pump.

A two stage design is used because such pumps are typically driven by a constant speed electrical motor operating in an open loop mode. An example of a pump having all of these characteristics is the prior art Enerpac 20-Series electric pump, available from Enerpac, a unit of Actuant Corporation, Milwaukee, Wis.

Attempts have been made to make a pump serve low pressures and high pressures with a single pump by varying the speed of the motor which drives the pump. Such attempts have involved measuring the pressure output of the pump, and using that as an input to the motor controller to set the speed of the pump. Requiring a pressure detector adds expense to the pump, making it impractical for many applications.

In a related application, variable displacement axial piston pumps are also currently available. The axial pistons run on a swashplate. The swashplate is hinged to allow the pistons to change their displacement in the piston bores. When the swashplate is at a large angle from 90° to the pistons, the pistons have long strokes and therefore large displacements. When the swashplate is at a small angle from 90°, the pistons have short strokes and therefore small displacements. When the swashplate is at 90° to the pistons the pistons do not stroke and no flow is produced. To make this pump pressure compensated, a piston is attached to the swashplate that senses system pressure. This pump will provide a near constant horsepower system. These pumps are known in the industry and are similar to Rexroth A10VSO. These pumps are generally limited to lower pressures because of the frictional forces that are applied to the swashplate at high pressures.

Oftentimes, hydraulic pumps are used to power single acting hydraulic cylinders. Such cylinders are connected to a single hydraulic line, which provides fluid under pressure to extend or retract the cylinder, and the cylinder is moved in the other direction by a spring when the pressure is relieved. If the hydraulic line is long, or in very cold temperatures in which the hydraulic fluid becomes viscous, the spring may not be strong enough to return the cylinder. In such cases, one method of returning the cylinder is to apply suction to the fluid in the hydraulic line connected to the cylinder. It is an object of the present invention to provide a pump adapted for this as well.

SUMMARY OF THE INVENTION

The invention provides a variable speed hydraulic pump designed to operate at a maximum horsepower throughout it pressure band. In particular, the variable speed hydraulic pump includes a hydraulic pump unit coupled to a variable speed electric motor and to a hydraulic fluid source for pressurizing and pumping hydraulic fluid when operated by the motor. A motor controller is electrically connected to the motor to supply drive signals to the motor based on elecrtrical characteristics of the drive signal which are dependent on the motor load so as to provide an approximately constant horsepower output of the motor.

The invention therefore provides a hydraulic pump that uses a single stage pump and a variable speed motor. A pump of the invention provides high flow at low pressure and flow that varies inversely proportional to pressure without using a pressure transducer to provide an input to the motor controller. Ideally, the motor speed is varied so as to maximize the utilized horsepower of the pump motor at any given pressure, so that the load is served as quickly as possible by the pump. A pump motor controller is programmed to monitor the motor current and/or phase angle, which is related to the driven load, i.e., the pressure output of the pump, so as to enable the motor speed to be controlled in accordance with pump pressure without the need for a separate pump pressure sensor and associated electronics.

At low pressures, the motor spins at high speed to produce high flow. Since the pressure is low, the torque load on the motor is minimal and relatively little current is drawn by the motor. As the pressure, and therefore the torque and current draw, increases, the speed of the motor is gradually reduced in accordance with the increased load, preferably being reduced so as to maintain the power output relatively constant, at or near the maximum power output of the pump. The pump therefore supplies high pressure at a reduced flow, although not as reduced, particularly for intermediate pressures, as the prior two stage pumps.

In practicing the invention, a motor controller is used that monitors the current drawn by the motor and/or the phase angle. These parameters are roughly proportional to the pressure output of the pump, since higher pressures increase the torque on the pump drive motor, which increases the current draw and increases the phase angle. As the current draw goes up, the speed is correspondingly reduced by the controller to maintain the power output by the pump relatively constant.

In practicing the invention, since the pump is controlled by an electronic controller, the prior art pump's first stage bypass valve can be eliminated. Elimination of this bypass valve produces additional benefits since heat generated by the valve and the resulting-destruction of hydraulic oil is eliminated.

The invention also results in higher flow rates, at a given maximum horsepower rating, particularly for pressures that are above the first stage maximum pressure and below the second stage maximum pressure. The prior art pump has a flow curve that drops off at 1000 psi and remains constant until maximum pressure. This means that the flow at 3000 psi is the same as the flow at 10,000 psi. The new pump maximizes the flow at each pressure. For example, the flow at 3000 psi would be over 3 times greater than the flow at 10,000 psi.

It is preferred to use a gear pump in series to pre-charge a piston pump which is driven to supply the load. The gear pump provides a relatively low presssure (up to 100 psi for example) to provide a flow to the main pump with a pressure and flow rate that varies proportionally with pump speed so as to precharge the main pump and inhibit or prevent cavitation. At high speed the pressure is higher to help fill the main pump in less time. At low speeds, the pressure is lower, but cavitation is not a problem at low speeds.

Another preferred aspect of the invention is positive return of the piston or pistons of the main pump. In the prior art, the pistons were driven in reciprocation by a cam eccentric journalled to the drive shaft of the pump, and each piston was biased against the outer surface of the eccentric by a spring. The spring force had to be high to maintain the pistons in contact with the cam at high speeds, but this high force wastes power in the system. In a preferred aspect of the invention, the pistons are coupled to the eccentric so that the eccentric not only drives them in compression (toward top dead center) but also positively returns them in suction (toward bottom dead center), so the motor is not wasting power compressing the springs. The ability of the main pump to produce a subatmospheric pressure (suction) is also improved.

In this aspect, the pump motor is preferably reversible, and provision is made in the pump hydraulic circuit to create a vacuum in the outlet line by reversing the direction of the motor to drive a bidirectional supercharging pump in reverse, to aid removal of hydraulic fluid from the outlet line quickly, thereby resulting in fast retraction of hydraulic cylinders or other loads supplied by the pump. Preferably, both the main pump and the supercharging pump contribute to the suction pressure which provides for fast retraction.

As another preferred feature of the invention, the electronic controller that controls the pump drive motor is programmed to reduce the flow by reducing the speed of the pump drive motor at the maximum pressure of the pump, e.g., at 10,000 psi, to reduce the amount of fluid which is pumped over the maximum pressure relief valve, and thereby reduce heating of the fluid. The flow that is produced is enough to keep the system at pressure and make up for any leakage in the system.

These and other objects and advantages of the invention will be apparent to those skilled in the art from the detailed description and drawings.

BRIEF DESCRIPTION OF THE DRAWINGS

FIG. 6 is a schematic of a hydraulic circuit for practicing the invention;

FIG. 7 is a graphical representation of pump flow versus pressure comparing a typical prior art two stage pump to a pump of the invention of comparable maximum capacity;

DETAILED DESCRIPTION OF THE PREFERRED EMBODIMENTS

Figure 1:
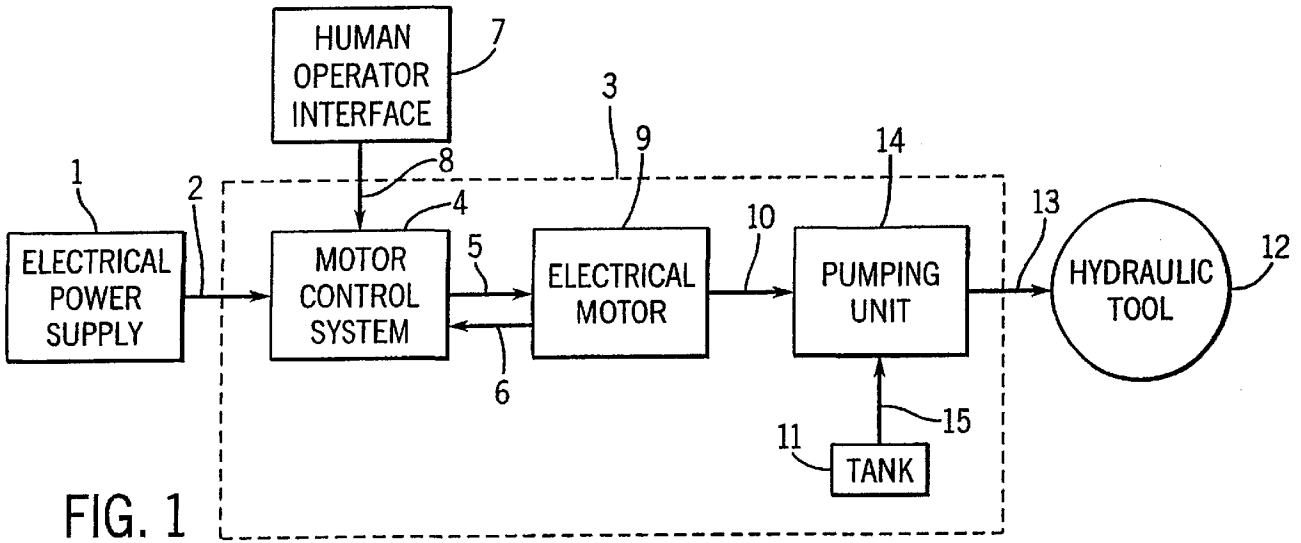
FIG. 1 is a schematic block diagram of a variable speed pump incorporating the invention.

Referring to FIG. 1, there is illustrated a block diagram of the variable speed pump. The block labeled 3 corresponds to the variable speed pump invention. The electrical power supply 1 to the pump is obtained through standard electrical distribution such as 120 VAC, 240 VAC, or other voltages and may be single phase or three phase in nature. It is shown supplying the pump 3 with electrical power by means of line 2. The output of the pump is a hydraulic line 13 that feeds a hydraulic tool 12, for example. The pump also has provisions for a human operator interface, i.e., a remote control pad, as shown by block 7. Block 7 provides inputs to the pump 3 such as power on, power off, forward, reverse and so on. These functions are communicated to the pump by means of line 8.

The variable speed pump 3 has three main components indicated by the motor control system 4, the electrical motor 9 and the hydraulic pumping unit 14. The pump also has a tank 11 to supply hydraulic fluid to the pump via line 15, and to store hydraulic fluid returned from the load.

The motor control system 4 has inputs for electrical power via line 2, and a human operator interface via line 8. The motor control system 4 is electrically connected via lines 5 and 6 to the motor 9. It can monitor the motor current to determine the load of the electrical motor 9 via line 6. A drive signal for the motor 9 is generated in the controller 4 based on the load of the motor. One means of doing this is by monitoring the motor current. The motor current is a relative indicator of the shaft torque load on the motor, which in turn is an indicator of the pressure on line 13 being delivered by the pumping unit 14. Thus the speed of the motor 9 can be varied (which varies the flow of the pump), depending on the output pressure of the pumping unit 14. At low pressures the controller 4 provides a signal which causes the motor 9 to run at high speed via line 5. At higher pressures, the controller 4 provides a signal which causes the motor to run at progressively lower speeds, inversely proportional to the pressure, so as to produce a relatively constant power output, which is proportional to the product of pressure times flow rate. The motor 9 is directly connected to drive the pumping unit 14, i.e., the motor drive shaft is connected to the pump drive shaft by a direct coupling, or a belt or chain drive, so that as the motor speed is varied the pump speed is also varied. In some cases, because of motor speed or torque limitations, a reduction may be provided, for example a gearbox, between the motor and the pump, which will, in that case, produce a pump speed that is proportional to the motor speed.

Any type of electrical motor in which characteristics of the current drawn by the motor vary with the pressure output of the pump may be used to practice the invention. Such motors include AC induction motors, switched reluctance motors, universal motors, DC and DC brushless motors. Characteristics other than the magnitude of the current may be monitored to give an indication of the torque, and therefore the pressure, produced by the motor. For example, the phase angle may be measured or calculated and used as such an indication. Motor controllers for measuring and monitoring current characteristics and relating them to the torque produced by the motor, to control the torque or speed of the motor, are well known and commercially available. For example, a dedicated constant horsepower drive could be used to practice the invention, or a flux vector drive, such as the "Impact" drive (for an AC induction motor) from Rockwell Automation, Milwaukee, Wis. or a motor/drive system (for a switch reluctance motor) available from Mavrick Motors, Mentor, Ohio, could be programmed to provide constant horsepower over the entire operating range.

To provide the most efficient performance of the pump, the speed of the pump is controlled by the controller to yield the maximum power output of the motor, and therefore of the pump, at each operating pressure. Thus, for a given horsepower motor, for example, 1½ hp, the controller monitors the current characteristics, and adjusts the speed, i.e., it adjusts the frequency, phase angle and voltage of the electrical signal which drives the motor, to yield 1½ hp (disregarding the negligible horsepower required to drive the supercharging pump with the same motor), according to the equation EP=KST, where HP is horsepower, K is a proportionality factor, S is speed and T is torque. Therefore, at any pressure demanded by the hydraulic load, certain current characteristics will be detected by the motor controller, and the controller will deliver power to the motor to drive it at the maximum speed it is capable of (at its horsepower rating) at that pressure. The maximum flow rate which the motor 9/pump 14 combination is capable of producing at that pressure at the horsepower rating of the motor 9 will therefore be delivered to the load.

Figure 2:
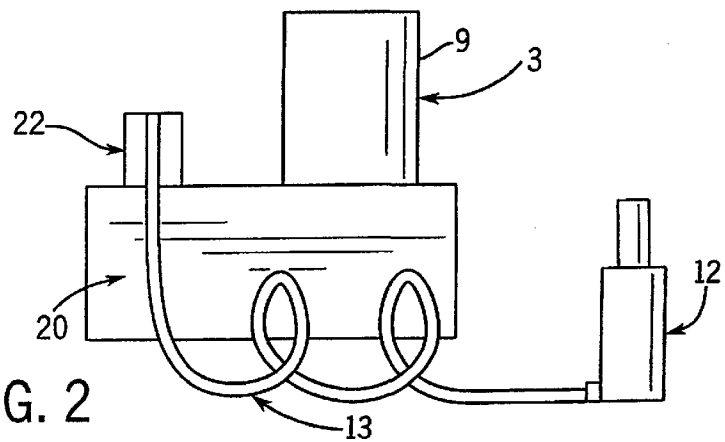
FIG. 2 is a physical schematic diagram illustrating the main components of a pump of the invention, hydraulically connected to a single acting hydraulic actuator.

Referring to FIG. 2, the pump 3 also includes a housing 20 and a valve 22. As illustrated in FIG. 2, the tool 12 is a single acting hydraulic cylinder. When the valve 22 and motor 9 are in the advance mode, the pump 3 will supply pressurized fluid to the cylinder 12. When the valve 8 is in the retract mode and the motor 9 is running backwards, the pump 3 will pump fluid from the hydraulic hose 13 and will retract the cylinder 12. The motor control system 4, pumping unit 14 and tank 11 are housed in the housing 20.

Figure 3:
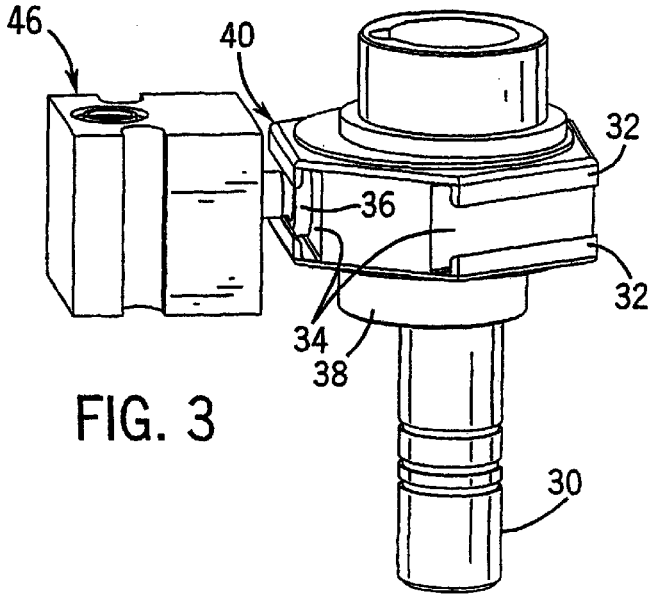
FIG. 3 is a perspective view of the main pump drive, illustrated along with one pumping unit.
Figure 4:
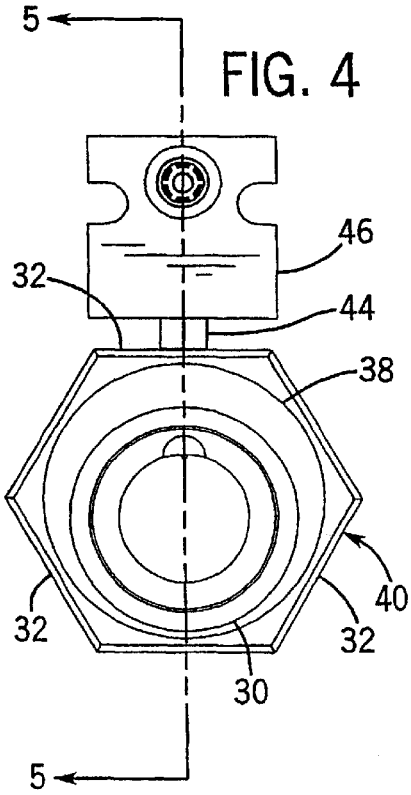
FIG. 4 is a top plan view of FIG. 3.
Figure 5:
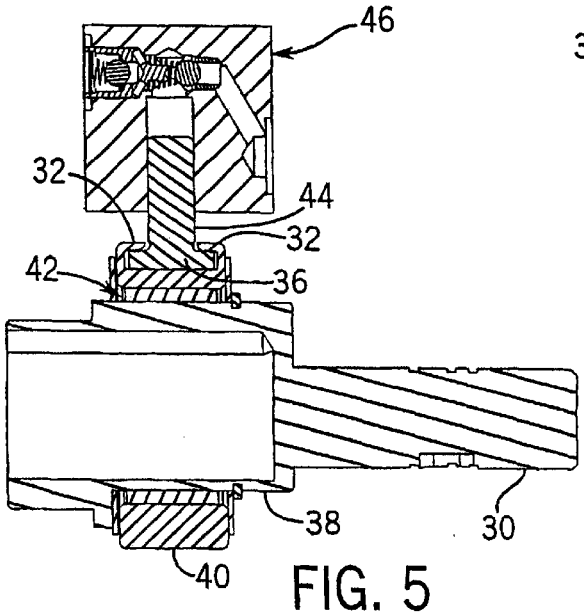
FIG. 5 is a cross-sectional view from the plane of the line 5—5 of FIG. 4.

FIGS. 3–5 illustrate a mechanical drive for the pumping unit 14. As is common in such drives, a shaft 30, which is driven by the motor 9, has an eccentric 38 on which is journalled a hex cam 40 by a bearing 42. The hex cam 40 has six sides as is common, but the cam 40 is unique in that three of its sides have flanges 32 that define T-shaped slots 34. The three sides of the cam 40 that have the flanges 32 are equi-angularly spaced from one another, and receive in each slot 34 a head 36 of a piston 44 which reciprocates in a pumping chamber of a piston block 46. There are three blocks 46 and associated pistons 44 equally spaced around the cam 40, with the head of each piston 44 received in a different one of the slots 34, although only one block 46 and associated piston 44 is illustrated in FIGS. 3–5. Any number could be provided. Appropriate check valves permit flow into the pumping chamber inside the block 2 on a suction stroke and flow out of the chamber on a pumping stroke, as illustrated and as is well known in the art.

As the shaft 30 is rotated, eccentric 38 orbits around the axis of the shaft 30. The hex cam 40 is not allowed to rotate but does orbit with the eccentric 38, causing the pistons 44 (only one shown, as explained above) to reciprocate in their corresponding valve blocks 46. When the shaft 30 is rotating, the pistons 44 will separate from the abutting faces of the hex cam 40 during the retract motion. Most pumps use a spring to keep the face of each piston 44 in contact with the face of the hex cam 40. At high speeds a high spring force is required to keep the piston in contact with the cam which creates inefficiencies in the pump. Springs are not used in the preferred embodiment, since the flanges 32 pull the shoulders of the heads 36 of the pistons 44 to retract the pistons 44 on their suction strokes.

Figure 9:
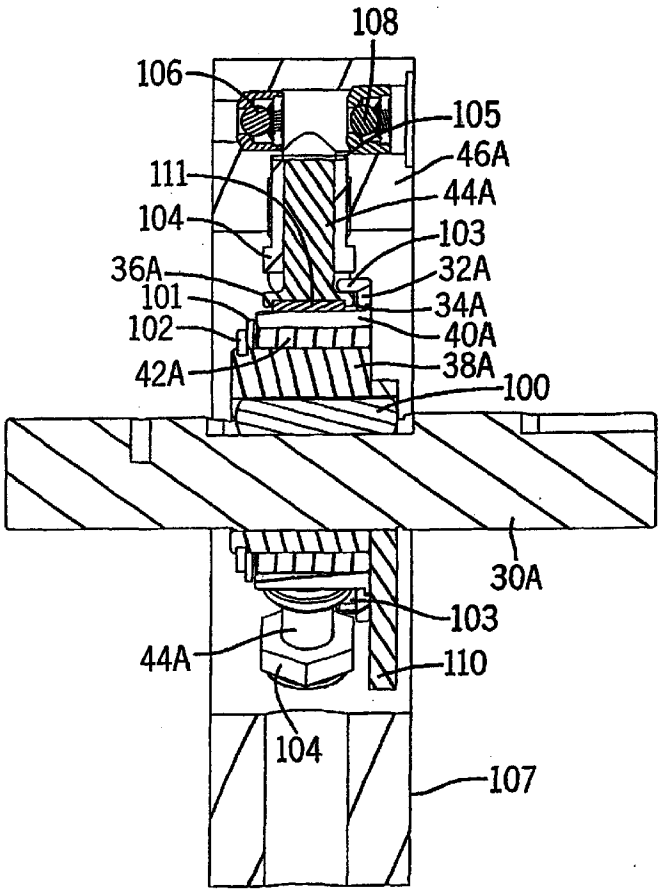
FIG. 9 is a cross-sectional view along line 9—9 of FIG. 8.
Figure 8:
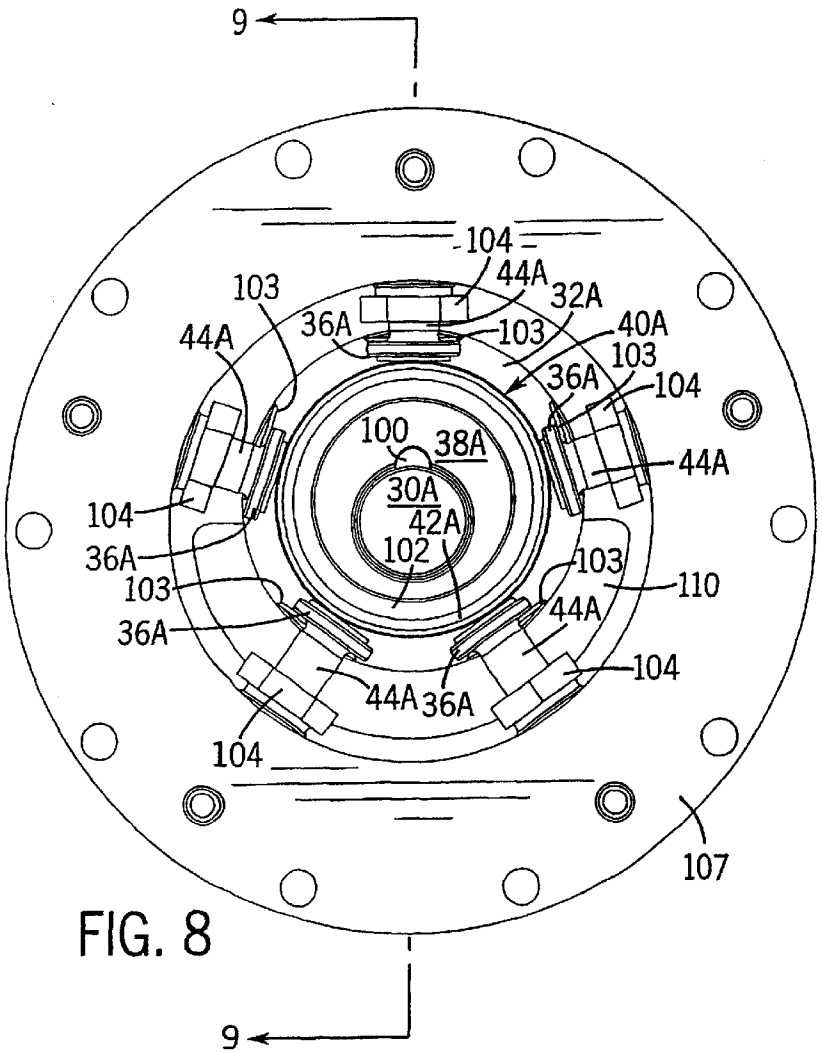
FIG. 8 is a top view of an alternate pump drive with five pump units.
Figure 10:
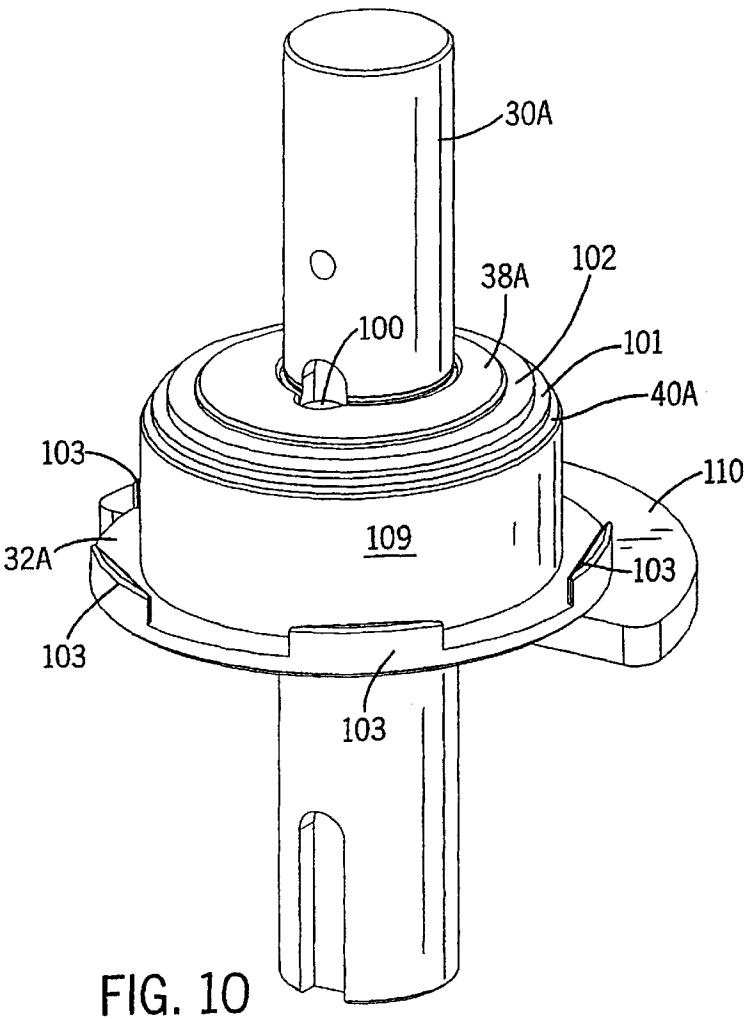
FIG. 10 is a perspective view of a shaft mounted eccentric and ring cam for the embodiment of FIG. 8.

FIGS. 8, 9 and 10 illustrate an alternate embodiment of the mechanical drive. Like elements in this embodiment are referred to in the drawings with similar numerals as in the above described embodiment although with the suffix "A". In particular, a shaft 30A, driven by the motor 9, mounts a separate eccentric 38A by a key or dowel pin 100. A ring cam 40A is journalled to the eccentric 38A by a bearing 42A held in place by a washer 101 and snap ring 102. Although circular instead of hex shaped, the cam 40A is like that in the above embodiment in that it has a flange 32A, albeit only at one side, that includes five axial tabs 103 that define slots 34A which receive flanged heads 36A of pistons 44A which reciprocate in a pumping chamber of piston blocks 46A lined by steel piston sleeves 104 preferably scaled at the bottom by copper gaskets 105 and having a threaded outer diameter that engages with threaded openings in block 46A. There are five blocks 46A and associated pistons 44A equally spaced around the cam 40A and defined by annular housing 107. Appropriate check valves 106 and 108 respectively permit flow into the pumping chamber inside the block on a suction stroke and flow out of the chamber on a pumping stroke, as illustrated and as is well known in the art. A generally semi-circular counterweight 110 is mounted to the shaft 30A by the dowel pin 100 at the short side of the eccentric 38A to balance the weight of the eccentric 38A and reduce vibration when the shaft 30A is rotated.

Like the embodiment of FIGS. 3–5, as the shaft 30A is rotated, the eccentric 38A orbits around the axis of the shaft 30A. The cam 40A is not allowed to rotate but orbits with the eccentric 38A, causing the pistons 44A to reciprocate in their corresponding cylinder blocks 46A. When the shaft 30A is rotating, the pistons 44A will be consecutively forced into the pump chambers during their pump strokes by contact with an annular surface 109 of the cam 40A as the eccentric orbits toward each piston. Again like the first embodiment, springs are not used to retract the pistons 44A since the flange tabs 103 pull the shoulders of the heads 36A of the pistons 44A on their suction strokes. The piston heads 36A include a liner 111 preferably made of a hard plastic, such as a polyamide-imide (commercially available as Torlon® a registered trademark of Amoco Performance Products), for reducing friction and noise when the piston heads 36A are engaged by the cam 40A.

Figure 11:
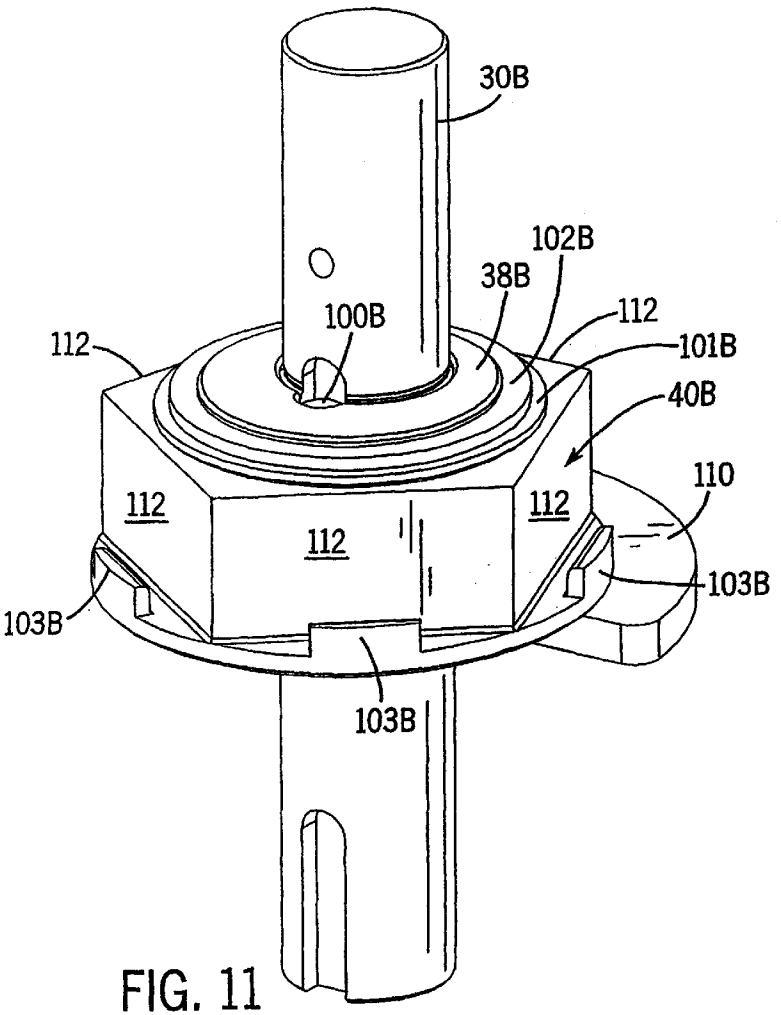
FIG. 11 is a perspective view similar to FIG. 10 of another alternate embodiment with a five-sided cam.

FIG. 11 illustrates yet another embodiment of the mechanical drive with a cam element having a flange at only one side for engaging the pistons. This embodiment is nearly identical to the embodiments of FIGS. 8–10 although employing a five-sided cam element. In this embodiment, like elements are referred to using similar reference numbers albeit with the suffix "B". Specifically, a shaft 30B, driven by the motor 9, mounts a separate eccentric 38B by a dowel pin 100B. A five-sided cam 40B, having five flat outer surfaces 112, is journalled to the eccentric 388B by a bearing 42B held in place by a washer 101B and snap ring 102B. Although five-sided rather than circular, the cam 40B is like that in the embodiment of FIGS. 8–10 in that it has a flange 32B at one side that includes five axial tabs 103B that define slots 34B which receive flanged piston heads disposed in five blocks as shown and described in the embodiment shown in FIGS. 8–10. Also like the embodiment of FIGS. 8–10, a generally semi-circular counterweight 110B is mounted to the shaft 30B by the dowel pin 100B or other suitable means at the short side of the eccentric 388B to balance the weight of the eccentric 388B and reduce vibration when the shaft 30B is rotated.

As in the above embodiments, as the shaft 30B is rotated, the eccentric 38B orbits around the axis of the shaft 30B. The cam 40B is not allowed to rotate but orbits with the eccentric 38B, causing the pistons to reciprocate in their corresponding valve blocks. When the shaft 30B is rotating, the pistons will be consecutively forced into the pump chambers during their pump strokes by contact with one of the five flat surfaces 112 as the eccentric 38B orbits toward each piston. Again like the embodiment of FIGS. 8–10, springs are not used to retract the pistons since the flange tabs 103B pull the shoulders of the heads of the pistons on their suction strokes.

FIG. 6 graphically depicts the system in hydraulic schematic circuit diagram form. There are two pumping units 50 and 14 that are driven by the motor 9. The pumping unit 14 is the main pump, which includes the three sets of pistons 44 and blocks 46 (or five sets of pistons 44A and blocks 46A depending on the drive unit configuration). The pumping unit 50 is a low pressure pump, such as a gear pump or gerotor pump, for supercharging the pumping unit 14, i.e., for supercharging the three pumping chambers of the pumping unit 14. The valve 22 is a four way three position valve which provides an interface between the tool 12 and the pump 3. When the pump 3 is not performing work, the valve 22 is set to the center position, in which position the valve 18 holds the load of the hydraulic device 12. When shifted to the left, the valve 22 moves into an advance position in which it directs flow from the pumping unit 14 to the load 12, and connects the tank 11 to line 40. During the advance operation, oil is drawn up from the reservoir 11 through the filter 42. The fluid goes through the pumping unit 50 and is supercharged by pumping unit 50 to a low pressure preferably less than 100 psi, for example about 50 psi, and fed into the pumping unit 14. Excess flow not fed to the pumping unit 14 flows through check valve 54 and through orifice 56 and back to tank 11. The check valve 54 and orifice 56 maintain a relatively constant pressure between the pumping units 50 and 14, so that unit 14 is substantially always fed with supercharged fluid. However, the precharge pressure delivered by pump 50 does vary with motor speed, because the flow rate delivered by pump 50 exceeds that of pump 14 as the motor speed increases, and the back pressure created by orifice 56 correspondingly increases up to, for example, 100 psi, although it could be somewhat higher or lower. This has a beneficial effect to reduce cavitation at higher motor speeds. One purpose of check valve 58 is, in case a condition arises in which pumping unit 50 does not provide a sufficient flow to charge the unit 14, unit 14 can draw directly from tank 11 through valve 58 and filter 60. A pressure relief valve 62 is used to keep the pressure of the system to a set maximum level, e.g., 10,000 psi. With the valve 22 shifted to the advance mode the fluid is pumped out of the pump 3 and into the hydraulic device 12.

Shifting valve 22 rightward from the center position places the pump 3 into retract mode. In this mode, the load 12 is placed in communication through check valve 66 with the normal fluid inlet to unit 14 and the normal fluid outlet of unit 50. Also in retract mode, the direction the motor is driven is reversed, so that the unit 50, which is a bidirectional pump, pumps toward the tank 11. The pump 14, which is a uni-directional pump, continues to pump toward valve 22 even though the drive shaft direction is reversed, and that flow is directed by valve 22 to tank 11 in the retract mode. Both units 14 and 50 create a suction which draws fluid through the check valve 66 from the hydraulic device 12. If the units 14 and 50 are creating a suction, the check valve 54 will be closed. If the return pressure exerted by the load is sufficient, the units 14 and 50 will have to do little, if any, work, since the pumping power will be provided by the load. If not, however, the units 14 and 50 will help drain the fluid from the device 12.

The check valve 58 is also used as a safety device for when the hydraulic device 12 becomes completely depleted of fluid in the retract mode. In that event, the valve 66 will close under the force of its spring and the suction provided by the units 14 and 50 will open the valve 58, thereby circulating the oil from the tank back to the tank through both units 14 and 50, to avoid running the units 14 and 50 dry.

A desirable feature of the variable speed pump 3 is the ability to limit the flow at the high pressure limit, e.g., 10,000 psi. When the controller detects, by monitoring the current to the motor, that the pump has reached the pressure limit, e.g. 10,000 psi, the controller is programmed to slow the pump rotation to a speed just necessary to maintain the pressure at this level. This greatly reduces the heat generated in the pump 14 and provides benefits in terms of increased life of the hydraulic fluid and reduced stress on the components of the pump.

FIG. 7 shows the flow versus pressure of a typical prior art two stage pump compared to a pump of the first embodiment of the present invention with the same pressure limit and flow characteristics. The first-stage pump of the prior art pump operates at a high flow until a given pressure, indicated as 1,000 psi, when the first stage bypass valve opens. The second-stage pump then supplies a much lower flow up to the high pressure limit, 10,000 psi. The new pump uses one pumping unit 14 that will have variable flow to achieve the maximum flow at any point in the pressure range. The area between the two curves represents the added work that the new pump is able to produce over the old pump.

Thus, the invention provides an improved hydraulic pump in which a pumping unit is driven with a variable speed, the speed being set according to the pressure demanded by the load so as to yield a relatively constant power output of the pump in terms of pressure and flow rate. This is accomplished by monitoring the current (or other electrical characteristic of the motor that varies with load) of the motor that drives the pumping unit, and increasing or decreasing the speed of the motor so as to provide a constant horsepower output of the motor. The motor controller is programmed to monitor characteristics of the motor current, such as magnitude and/or phase angle, which are related to the torque load on the motor, so as to enable the motor speed to be controlled in accordance with pump pressure without the need for a separate pump pressure sensor and associated electronics.

Preferably, a single pumping unit is provided to serve the load, and to reduce cavitation, the pumping unit is supercharged with a low pressure source of fluid.

In addition, the pistons are positively returned by the drive cam, to eliminate power wasting springs.

Another desirable feature of the invention is the ability of the pump to produce suction to return fluid to the pump. This is accomplished by using a three position, four way valve which in a retract position communicates the pumping unit to tank and communicates the load to the input port of the pumping unit. The motor is also driven in reverse, to reverse the pumping direction of the supercharging pump. Positive return of the pistons also contributes to the ability of the pump to produce suction. As such both pumping units produce a vacuum which draws fluid from the load, to thereby remove hydraulic fluid from the outlet line quickly.

In another preferred feature, the pump detects when the pressure limit is reached and reduces the flow rate to be just sufficient to maintain the pressure at the limit. This is accomplished by programming the motor controller to detect, by monitoring the current characteristics, when the pressure limit has been reached, and to reduce the motor speed until the pressure starts dropping, at which point the motor speed is slightly increased. This process is continued so that the speed hovers at a magnitude which is just barely sufficient to maintain the pressure limit, until the pressure subsides or the pump is turned off.

A preferred embodiment of the invention has been described in detail. Many modifications and variations will be apparent to those skilled in the art. Therefore, the invention should not be limited to the preferred embodiment described, rather reference should be made to the following claims.

We claim:

1. A variable speed hydraulic pump, comprising:

a variable speed electric pump drive motor;

a hydraulic pump unit coupled to the electric motor and a hydraulic fluid source for pumping hydraulic fluid when operated by the motor; and a motor controller electrically connected to the motor for supplying an electrical drive signal to the motor in response to an electrical motor load signal characteristic of said drive signal which varies dependent on the torque exerted by said motor, said electrical motor load signal characteristic being detected by said motor controller, and wherein said motor controller changes said electrical drive signal supplied to said motor so as to output a constant power from said motor to said pump over substantially the entire operating pressure range of said pump;

wherein the motor controller is programmed to decrease the speed of the motor when the motor load signal characteristic corresponds to a maximum rated pump pressure so as to maintain essentially said maximum rated pump pressure.

2. The variable speed hydraulic pump of claim 1, wherein the motor load signal characteristic is motor current.

3. The variable speed hydraulic pump of claim 1, wherein the motor load signal characteristic is motor current phase angle.

4. The variable speed hydraulic pump of claim 1, wherein the motor is coupled to the hydraulic pump unit by a drive unit that positively drives the hydraulic pump unit in compression and suction.

5. The variable speed hydraulic pump of claim 4, further comprising a bidirectional supercharging pump driven by said motor, and wherein the motor can be reversed so that the supercharging pump can suck fluid from a hydraulic load supplied with said fluid by the hydraulic pump unit.

6. The variable speed hydraulic pump of claim 5, wherein the hydraulic pump unit is a piston pump.

7. The variable speed hydraulic pump of claim 6, wherein the supercharging pump is a gear pump.

8. The variable speed hydraulic pump of claim 6, wherein the hydraulic pump unit includes a housing defining a plurality of piston chambers in communication with inlet and outlet ports and housing a plurality of pistons movable in succession as the drive unit is rotated by the motor.

9. The variable speed hydraulic pump of claim 8, wherein the piston chambers are lined by piston inserts.

10. The variable speed hydraulic pump of claim 8, further including a fluid tank containing hydraulic fluid in communication with the pump chambers through hydraulic lines.

11. The variable speed hydraulic pump of claim 8, wherein the drive unit includes a shaft coupled at one end to the rotor of the motor, the shaft supporting an eccentric to which is fixed a cam element.

12. The variable speed hydraulic pump of claim 11, wherein the drive unit includes a weight fixed to the shaft to counterbalance the eccentric.

13. The variable speed hydraulic pump of claim 11, wherein the cam element engages heads of the pistons in a plurality of slots spaced about the cam element such that the cam element moves the pistons into and out of the piston chambers.

14. The variable speed hydraulic pump of claim 13, wherein the slots are defined by flanges extending radially outward from the cam element.

15. The variable speed hydraulic pump of claim 14, wherein the cam element includes an annular surface for contacting the pistons.

16. The variable speed hydraulic pump of claim 14, wherein the cam element includes multiple flat surfaces for contacting the pistons.

17. The variable speed hydraulic pump of claim 4, further comprising a valve that in a retract mode connects an intake port of said hydraulic pump unit with the hydraulic load normally supplied by said hydraulic pump unit.

18. The variable speed hydraulic pump of claim 17, further comprising a bidirectional supercharging pump connected to an inlet port of said hydraulic pump unit and driven by said motor, and wherein the motor can be reversed so that the supercharging pump can suck fluid from a hydraulic load supplied with said fluid by the hydraulic pump unit.

19. The variable speed hydraulic pump of claim 18, wherein said supercharging pump is limited by a pressure relief valve to a pressure output of less than 100 psi.

* * * * *